US011418865B2

(12) United States Patent
Krull

(10) Patent No.: US 11,418,865 B2
(45) Date of Patent: Aug. 16, 2022

(54) CONFIGURABLE HEARING DEVICES

(71) Applicant: GN Hearing A/S, Ballerup (DK)

(72) Inventor: Vidya Krull, Highland Park, IL (US)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/213,989

(22) Filed: Dec. 7, 2018

(65) Prior Publication Data

US 2020/0186904 A1 Jun. 11, 2020

(51) Int. Cl.
*H04R 1/10* (2006.01)
*H04R 25/00* (2006.01)

(52) U.S. Cl.
CPC ..... *H04R 1/1016* (2013.01); *H04R 1/105* (2013.01); *H04R 1/1041* (2013.01); *H04R 25/554* (2013.01); *H04R 25/65* (2013.01); *H04R 2225/0213* (2019.05); *H04R 2420/07* (2013.01)

(58) Field of Classification Search
CPC .... H04R 1/1016; H04R 1/1041; H04R 1/105; H04R 25/554; H04R 25/65; H04R 2225/0213; H04R 2420/07; H04R 2225/61; H04R 2225/77; H04R 25/659; H04R 25/652; H04R 25/658; H04R 29/001; H04R 2460/15; A61F 11/10; A61F 2210/0014
See application file for complete search history.

(56) References Cited

U.S. PATENT DOCUMENTS 4,962,537 A 10/1990 Basel et al.
6,052,473 A * 4/2000 Clavadetscher ..... H04R 25/656 381/322
6,359,993 B2 * 3/2002 Brimhall ..... H04R 25/456 381/328
6,393,130 B1 * 5/2002 Stonikas ..... H04R 25/658 381/328
7,362,875 B2 4/2008 Saxton et al.
7,778,434 B2 8/2010 Juneau et al.
8,340,338 B2 12/2012 Mlodzikowski et al.
8,678,011 B2 3/2014 Goldstein et al.
9,774,962 B2 * 9/2017 Karamuk ..... H04R 25/652
10,506,320 B1 * 12/2019 Lott ..... H04R 25/652
2004/0234090 A1 * 11/2004 Berg ..... H04R 25/70 381/314
2004/0258263 A1 * 12/2004 Saxton ..... H04R 25/652 381/328
2006/0009883 A1 1/2006 Takeichi et al.
2007/0121980 A1 * 5/2007 Menzl ..... H04R 25/656 381/328

(Continued)

FOREIGN PATENT DOCUMENTS

WO 2018099562 A1 6/2018

*Primary Examiner* — Angelica M McKinney
(74) *Attorney, Agent, or Firm* — Vista IP Law Group, LLP

(57) ABSTRACT

An earpiece includes: a first portion configured for placement in an ear canal, the first portion having an asymmetrical configuration; wherein the first portion is configured to exhibit a first property in a first state in response to a stimulus, and to exhibit a second property in a second state in an absence of the stimulus; and wherein the first portion is elastically compressible when the first portion is in the first state and the second state. A hearing device includes: a component configured to provide an output; and an earpiece having a first portion configured to change shape or a material property in response to the output provided by the component.

46 Claims, 7 Drawing Sheets

(56) References Cited

U.S. PATENT DOCUMENTS

| | | | | |
|---|---|---|---|---|
| 2008/0299339 | A1* | 12/2008 | Keady | A61L 27/34 428/35.7 |
| 2009/0110223 | A1* | 4/2009 | Semcken | H04R 25/656 381/329 |
| 2009/0214072 | A1* | 8/2009 | Staab | H04R 25/656 381/380 |
| 2010/0074451 | A1* | 3/2010 | Usher | H04R 29/00 381/58 |
| 2012/0103346 | A1* | 5/2012 | Keady | A61M 25/10181 128/865 |
| 2013/0114839 | A1* | 5/2013 | Gebert | H04R 25/656 381/328 |
| 2014/0270191 | A1* | 9/2014 | Nikles | H04R 25/554 381/23.1 |
| 2015/0289067 | A1* | 10/2015 | Riepenhoff | H04R 25/554 381/315 |
| 2016/0031735 | A1 | 2/2016 | Smith et al. | |
| 2016/0166203 | A1* | 6/2016 | Goldstein | H04R 25/00 600/509 |
| 2016/0295311 | A1* | 10/2016 | Keady | H04R 25/652 |
| 2017/0099553 | A1* | 4/2017 | Sacha | H04R 25/658 |
| 2017/0112671 | A1* | 4/2017 | Goldstein | H04R 25/554 |
| 2018/0220239 | A1* | 8/2018 | Keady | H04R 1/1016 |
| 2019/0037297 | A1* | 1/2019 | Goldstein | H04R 1/1091 |
| 2020/0029161 | A1* | 1/2020 | Thumm | H04R 25/652 |
| 2020/0186949 | A1* | 6/2020 | Krull | H04R 1/1016 |

* cited by examiner

CONFIGURABLE HEARING DEVICES

The present disclosure relates to hearing devices, such as hearing aids, and methods of making the same.

BACKGROUND

Comfort plays a major role in the acceptance of hearing technology. For instance, open-fit receiver-in-the-ear (RIE) devices have a standard dome that often hangs loosely in the canal and rubs against it, leading to poor fit, comfort, and itchiness. Furthermore, inappropriate dome size, shape, and design, as well as improperly selected dome configuration for a user may aggravate the comfort problem.

Sometimes, a custom shell may be provided to achieve a good fit. However, despite the customization of the shell, poor fit may still occur due to (1) hard shell materials slipping out of the greasy cartilaginous portion of the ear canal, which has cerumen and sweat glands, and/or (2) ear canal dynamics between the first ear canal bend and the second ear canal bend, as well as in the concha.

In addition, hard materials sometimes are preferred for making hearing aid shells over softer materials in order to achieve better durability and to take advantage of printing technology. Compared to acrylic material for making the hard shell, silicone and foam are more susceptible to degradation after prolonged contact with human ear canal.

However, custom hearing aids with hard shells may not be comfortable to wear. Market data historically shows fit and comfort as one of the top reasons why people choose not to wear hearing aids. Poor fit and comfort pose a greater challenge for custom products (e.g., devices, molds, and casings). In addition, ear canal dynamics, caused by jaw, head, and neck movements, may affect the fit and comfort for both customized and non-customized hearing devices. There is a gap in the knowledge of ear canal dynamics and how it varies in the general population. This limits the ability to provide hearing aid products that fit users better. Furthermore, poor fit of hearing aids adversely affects the effectiveness in feedback cancellation and appropriate gain provided by the hearing aids.

SUMMARY

It would be desirable to provide a hearing device that can address different comfort issues. It would also be desirable to provide a hearing device that can be inserted deeply into the ear canal while achieving a better fit and comfort. Such a hearing device may achieve fewer slit leaks, reduced occlusion effect, and/or reduced feedback.

An earpiece includes: a first portion configured for placement in an ear canal, the first portion having an asymmetrical configuration; wherein the first portion is configured to exhibit a first property in a first state in response to a stimulus, and to exhibit a second property in a second state in an absence of the stimulus; and wherein the first portion is elastically compressible when the first portion is in the first state and the second state.

Optionally, the first portion can reversibly achieve the first state and the second state.

Optionally, the first portion is customized, or a location of the first portion with respect to a remaining part of the earpiece is customized.

Optionally, the first property comprises a first stiffness, and the second property comprises a second stiffness that is higher than the first stiffness.

Optionally, the first property comprises a first shape, and the second property comprises a second shape that is different from the first shape.

Optionally, the earpiece comprises a component, or is coupled to a component, the component configured to provide the stimulus.

Optionally, the stimulus is for interacting with material of the first portion.

Optionally, the component is configured to provide the stimulus in response to an input received by the hearing device.

Optionally, the stimulus comprises heat, light, pressure, force, or an electrical signal.

Optionally, the earpiece further includes a user control configured to receive a user input, wherein the stimulus by the component is based on the user input.

Optionally, the earpiece further includes a wireless receiver configured to receive a signal from a device, wherein the stimulus by the component is based on the signal.

Optionally, the device comprises a fitting device, a cell phone, a remote control, a cloud server, or a computing device.

Optionally, the earpiece further includes a sensor configured to sense a characteristic, wherein the component is configured to provide the stimulus in response to the sensed characteristic.

Optionally, the first portion is made from a material having a shape memory characteristic.

Optionally, the material comprises a printed material.

Optionally, the first portion is configured for placement at a location along an ear canal that changes shape in response to jaw movement of a user of the hearing device.

Optionally, the earpiece further includes a second portion and a third portion, wherein the first portion is a hinge zone connecting the second portion and the third portion.

Optionally, the first portion is at least a part of a shell.

Optionally, the earpiece further includes a speaker accommodated in the shell.

A hearing aid includes the earpiece, wherein the hearing aid comprises a processor configured to perform hearing loss compensation.

A hearing device includes: a component configured to provide an output; and an earpiece having a first portion configured to change shape or a material property in response to the output provided by the component.

Optionally, the output comprises a stimulus for interacting with material of the first portion.

Optionally, the component is configured to provide the output in response to an input received by the hearing device.

Optionally, the output comprises heat, light, pressure, force, or an electrical signal.

Optionally, the hearing device further includes a user control configured to receive a user input, wherein the output by the component is based on the user input.

Optionally, the hearing device further includes a wireless receiver configured to receive a signal from a device, wherein the output by the component is based on the signal.

Optionally, the device from which the hearing device receives the signal comprises a fitting device.

Optionally, the device comprises a cell phone.

Optionally, the component comprises an actuator configured to bend the first portion of the earpiece to cause the first portion to change shape.

Optionally, the hearing device further includes a sensor configured to sense a characteristic, wherein the component is configured to provide the output in response to the sensed characteristic.

Optionally, the sensor comprises a temperature sensor, a pressure sensor, a force sensor, a strain gauge, a light sensor, or an electric signal sensor.

Optionally, the first portion is made from a material having a shape memory characteristic.

Optionally, the material comprises a printed material.

Optionally, the first portion is configured for placement at a location along an ear canal that changes shape in response to jaw movement of a user of the hearing device.

Optionally, the first portion is configured for placement at a first bend of an ear canal, the ear canal having a second bend located between the first bend and an eardrum.

Optionally, the hearing device further includes a second portion configured for placement at the second bend of the ear canal.

Optionally, the first portion is configured for placement in an ear canal, the canal having a first bend and a second bend located between the first bend and an eardrum, wherein the first portion is configured for placement at the second bend.

Optionally, the hearing device further includes a second portion and a third portion, wherein the first portion is a hinge zone connecting the second portion and the third portion.

Optionally, the first portion, the second portion, and the third portion are integrally formed together.

Optionally, the component is in the earpiece.

Optionally, the hearing device further includes a behind-the-ear (BTE) unit, wherein the component is in the BTE unit.

Optionally, the first portion is at least a part of a shell.

Optionally, the hearing device further includes a speaker accommodated in the shell.

Optionally, the first portion has a geometry that is customized.

Optionally, the hearing device comprises a hearing aid with a processor configured to perform hearing loss compensation.

Optionally, the first portion has an asymmetrical configuration; wherein the first portion is configured to exhibit a first property in a first state in response to a stimulus, and to exhibit a second property in a second state in an absence of the stimulus; and wherein the first portion is elastically compressible when the first portion is in the first state and the second state.

Other features and advantageous will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1A:
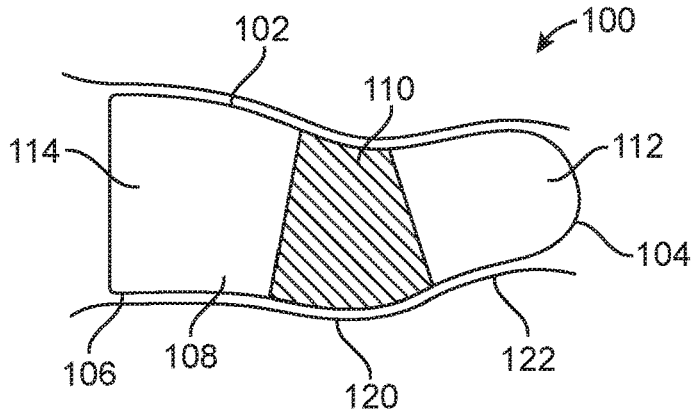
FIG. 1A illustrates a hearing device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Hearing devices constructed using programmable material(s) are described herein. The programmable material(s) may be used to form a shell of an earpiece, a sleeve of an ear piece, or other part(s) of a hearing device. In some embodiments, 3D or 4D printing material may be used to form portion(s) of an earpiece. In some cases the portion(s) of the earpiece may be passively and/or actively controlled, using reversible shape memory behaviour of the material(s), to better allow the earpiece to fit the dynamic ear canal.

The hearing device may be a hearing aid or a component (e.g., an earpiece) of a hearing aid. By means of non-limiting examples, the hearing aid may be a behind-the-ear (BTE) hearing aid, an in-the-ear (ITE) hearing aid, an in-the-canal (ITC) hearing aid, a completely-n-the canal (CIC) hearing aid, a receiver-in-canal (RIC) hearing aid, or a receiver-in-the-ear (RITE) hearing aid. Also, in some embodiments, the hearing aid may be bilaterally fit (one hearing aid in each ear of the user). The bilateral hearing aids may comprise a first earpiece and a second earpiece, wherein the first earpiece and/or the second earpiece is an earpiece as disclosed herein. Also, in some embodiments, the hearing device may be an Over-The-Counter (OTC) hearing aid that may be obtained without a prescription. The OTC hearing aid may be an ITE hearing aid, an ITC hearing aid, a CIC hearing aid, a BTE hearing aid, a RIC hearing aid, or a binaural hearing aid.

FIG. 1A illustrates a hearing device 100. The hearing device 100 includes an earpiece 102 having a first end 104, a second end 106, and a body 108 extending between the first end 104 and the second end 106. The first end 104 of the earpiece 102 is configured for placement further into an ear canal than the second end 106, so that when the earpiece 102 is worn by a user, the eardrum will be closer to the first end 104 of the earpiece 102 than the second end 106. As shown in the figure, the earpiece 102 has a first portion 110 configured for placement in the ear canal. The first portion is configured to exhibit a first property in a first state in response to a stimulus, and to exhibit a second property in a second state in an absence of the stimulus. In some embodiments, the first portion 110 is elastically compressible when the first portion 110 is in the first state and the second state. For example, the first portion 110 may be elastically compressed by the ear canal while the earpiece 102 is being worn by the user. Such feature allows the first portion 110 of the earpiece 102 to conform or to be compressed in response to movement of the ear canal or to a change is shape of the ear canal.

In some embodiments, the first property comprises a first stiffness, and the second property comprises a second stiffness that is higher than the first stiffness. In other embodiments, the first property comprises a first shape, and the second property comprises a second shape that is different from the first shape.

In some embodiments, the first portion 110 can reversibly achieve the first state and the second state.

In some embodiments, at least the first portion 110 of the earpiece 102 is made from material(s) having a shape memory characteristic, such as a shape memory polymer(s) (SMPs). For example, the first portion 110 of the earpiece 102 may be made from a single layer of SMP, two layers of SMPs, or may have a multilayer architecture with more than two layers of SMPs. If the first portion 110 has multiple layers of SMPs, then the SMPs in the different layers may be the same material, or different materials. Also, in some cases, the SMP(s) may be combined with printing material(s), such as 3D or 4D printing material(s), to form the first portion 110. In addition, in some embodiments, the SMP(s) of the first portion 110 may be coupled with other layer(s) of material(s) that is non-programmable. Also, in some embodiments, the first portion 110 of the earpiece 102 may be made from a programmable material(s) that exhibits small scale modulation in its property in response to stimulus, thereby resulting in shape transformation. Furthermore, in some embodiments, the first portion 110 of the earpiece 102 may be made from different materials having different shape memory characteristics (e.g., different rates of property change, different reaction rate in response to stimulus, different direction of reaction, etc.) so that a desire bending characteristic is provided for the first portion 110.

In any of the embodiments described herein the earpiece 102 may optionally further include a sleeve or outer layer configured to contain different layers of materials.

In some embodiments, the first portion 110 may have a flexibility that is lower than that of a remaining part of the earpiece 102. Also, in some cases, the flexibility of the first portion 110 may have a value that is sufficiently low for allowing the first portion 110 to deform to conform to the curvature of the ear canal as the earpiece 102 is inserted into the ear canal, and to conform with a changing shape of the ear canal due to physiological movement (e.g., jaw movement, head turning, etc.) of the user.

In the illustrated embodiments, the earpiece 102 and/or the first portion 110 has an asymmetrical configuration with respect to a longitudinal axis of the earpiece 102 when in a relaxed configuration (i.e., when the earpiece 102 is not worn by a user). In other embodiments, the earpiece 102 and/or the first portion 110 may have a symmetrical configuration with respect to a longitudinal axis of the earpiece 102.

Figure 1B:
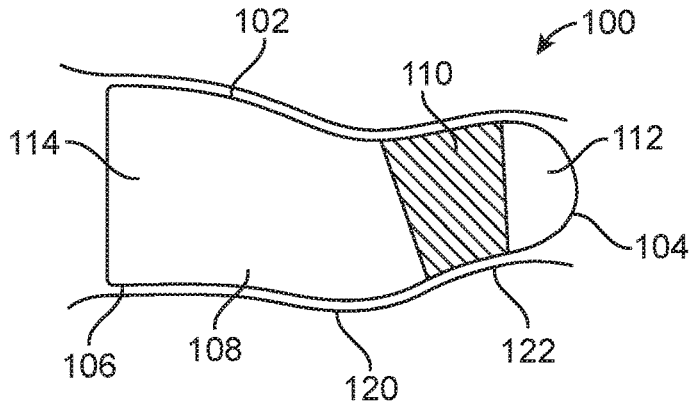
FIG. 1B illustrates a hearing device.

In the illustrated embodiments, the first portion 110 is located at a position with respect to the earpiece 102 such that when the earpiece 102 is inserted into an ear canal of the user, the first portion 110 will be at a bend of the ear canal. For example, the ear canal has a first bend 120, and a second bend 122 located between an eardrum and the first bend 120, and the first portion 110 may be configured for placement at the first bend 120 of the ear canal. As another example, the first portion 110 may be configured for placement at the second bend 122 of the ear canal (FIG. 1B).

In some embodiments, the first portion 110 is configured for placement at a location along an ear canal that changes shape in response to jaw movement of a user of the hearing device.

Figure 1C:
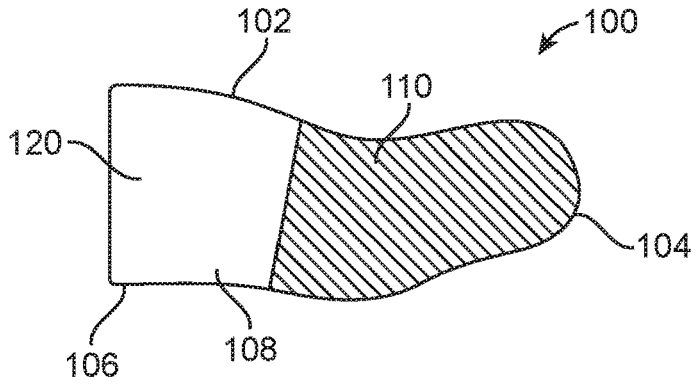
FIG. 1C illustrates a hearing device.

In the above embodiments, the earpiece also includes a second portion 112 and a third portion 114. The first portion 110 is between the second portion 112 and the third portion 114 so that the first portion 110 forms a hinge zone connecting the second portion 112 and the third portion 114. In other embodiments, the first portion 110 may extend to the tip of the first end 104 (FIG. 1C).

It should be noted that the size, shape, location, and extent of the first portion 110 are not limited to the examples illustrated previously, and that in other embodiments, the first portion 110 may have different sizes, different shapes, different locations, and/or different extents from those described previously.

In some embodiments, the first portion 110 is customized. For example, the size, shape, and extent of the first portion 110 may be customized for a particular user. Also, in some embodiments, a location of the first portion 110 with respect to a remaining part of the earpiece 102 is customized. In other embodiments, the earpiece including the first portion 110 may not be customized, and may instead have a standard configuration.

Also, in some embodiments, the earpiece 102 may have multiple first portions 110 at different locations of the earpiece 102. These portions 110 form different zones at the earpiece 102, and their locations are designed so that the portions 110 will be at positions in the ear canal where movements of the ear canal are expected to occur.

In some embodiments, the earpiece 102 has an internal cavity extending from the second end 106. The internal cavity of the earpiece 102 is sized and shaped to accommodate a hearing device component, such as a sound tube, a receiver, a housing, etc. In some embodiments, the earpiece 102 may not include such hearing device component. In other embodiments, the earpiece 102 may include the hearing device component.

During use, the earpiece 102 is placed in an ear canal of the user. The ear canal has a first bend and a second bend located between the first bend and an eardrum. In some embodiments, at least a part of the earpiece 102 is placed at the first bend of the ear canal. In other embodiments, at least a part of the earpiece 102 is placed at the second bend of the ear canal, which allows the earpiece 102 to be placed deeper in the ear canal. When the earpiece 102 is placed in the ear canal, the first portion 110 is located at a position in the ear canal where the ear canal may change shape due to physiological movement of the user (e.g., due to jaw movement, head turning, etc.). The first portion 110 is flexible and/or deformable, which allows the earpiece 102 to conform with a changing shape of the ear canal.

Figure 2A:
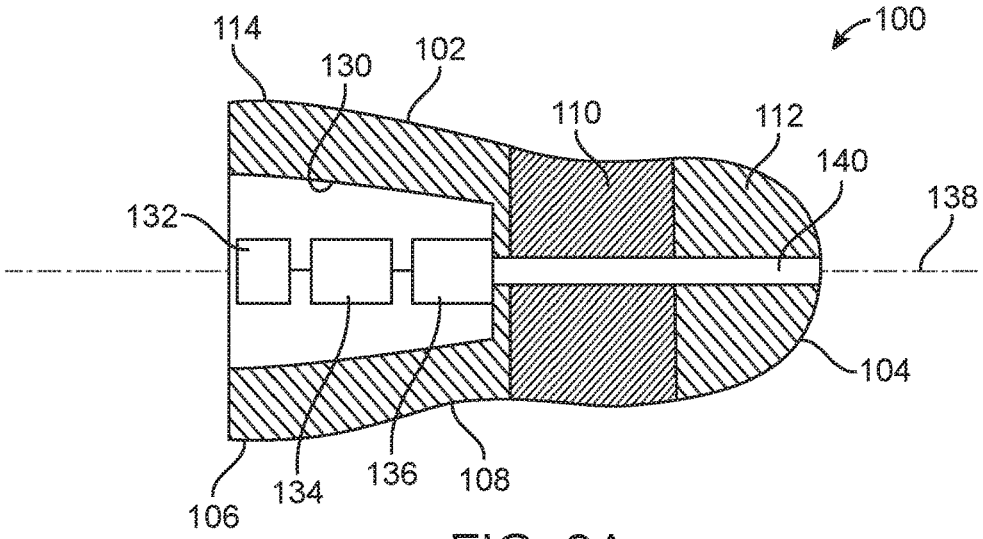
FIG. 2A illustrates a hearing device.

FIG. 2A illustrates a hearing device 100 having an earpiece 102. The earpiece 102 may be the same as that described with reference to any of the embodiments of FIGS. 1A-1C. The earpiece 102 has a cavity configured to accommodate a housing 130. As shown in FIG. 2, the earpiece 102 also includes a microphone 132, a processing unit 134, and a receiver (speaker) 136 located in the housing 130. The earpiece 102 also includes a passage 140 located in the body 108 of the earpiece 102. The passage 140 extends from a tip of the first end 104 of the earpiece 102 to the receiver 136. The earpiece 102 itself is a stand-alone hearing aid configured for placement in an ear of the user. During use, the microphone 132 picks up sound from the environment and converts the sound to audio signal. The processing unit 134 is configured to process the audio signal in accordance with a hearing loss compensation algorithm to compensate for hearing loss of the user of the earpiece 102. The processing unit 134 may be implemented using hardware, software, or a combination of both. The processing unit 134 outputs a processed audio signal compensating for the hearing loss of the user, and the receiver 136 converts the processed audio signal into output sound. The output sound is transmitted via the passage 140 and exits the first end 104 of the earpiece 102 for reception by an eardrum of the user.

In some embodiments, the portions 110, 112, 114 of the earpiece 102 may form a sleeve that is configured to accommodate the housing 130. In one implementation, the sleeve and the housing 130 may be manufactured separately, and the housing 130 is then inserted into the sleeve after they are manufactured. In other embodiments, the sleeve may be formed on the housing 130. In further embodiments, the sleeve and the housing 130 may be formed together so that they have an unity configuration. Also, in some embodiments, the first portion 110 may be formed as at least a part of a shell (e.g., a earpiece housing). In such cases, the earpiece 102 may further include a speaker accommodated in the shell.

In some embodiments, the same passage 140 in the earpiece 102 may also serve to receive feedback from within the ear canal, and to transmit the feedback signal to a microphone in the earpiece 102. In other embodiments, the earpiece 102 may have another channel configured to receive feedback signal from within the ear canal, and to transmit the feedback signal to a microphone in the earpiece 102. Also, in some embodiments, the channel for transmitting feedback signal may be customizable (e.g., the position and/or orientation of such channel may be customized for a particular user).

In other embodiments, the hearing device 102 may further include a battery compartment (not shown) for powering the receiver 136. The hearing device 102 may also optionally include a retrieval line coupled to the second end 106 of the earpiece 102 for allowing a user to remove the earpiece 102 from the ear canal by pulling on the retrieval line.

Figure 2B:
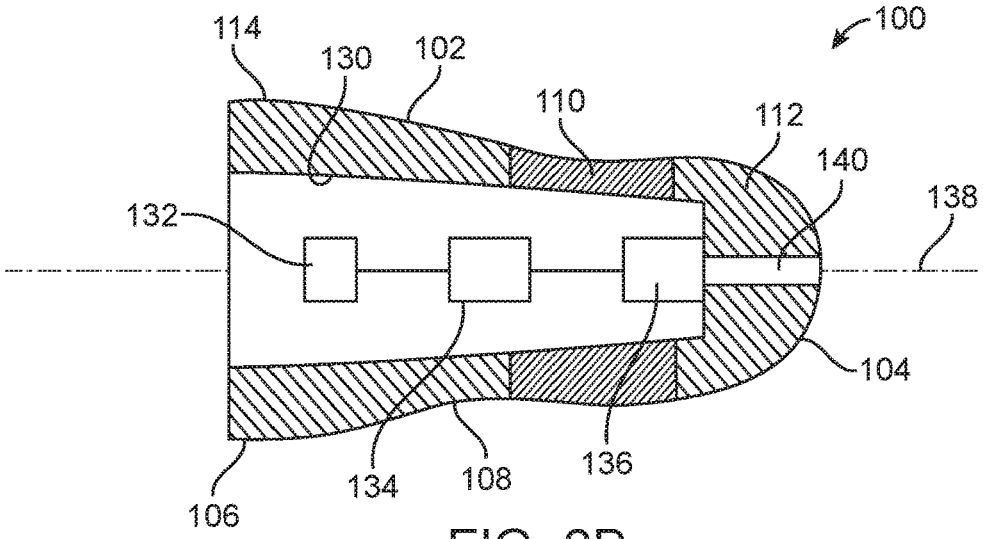
FIG. 2B illustrates a hearing device.

In the illustrated embodiments, the first portion 110 is proximal to the housing 130 with respect to a longitudinal axis 138 of the earpiece 102, and the passage 140 extends through the first portion 110. In other embodiments, at least a part of the first portion 110, and at least a part of the housing 130 may be located at the same longitudinal position with respect to the longitudinal axis 138 of the earpiece 102. For example, as shown in FIG. 2B, the first portion 110 may surround the housing 130 in some embodiments.

Figure 3:
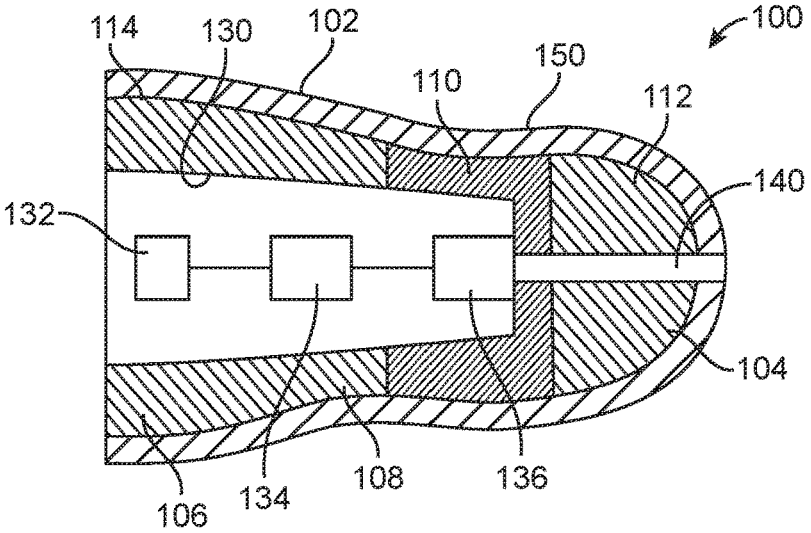
FIG. 3 illustrates a hearing device.

In any of the embodiments described herein, the earpiece 102 may optionally further include an outer layer 150 (FIG. 3). The outer layer 150 may be made from a polymer, a foam, a gel, or any material that is deformable. The outer layer 150 is configured to provide additional comfort for the user.

Figure 4:
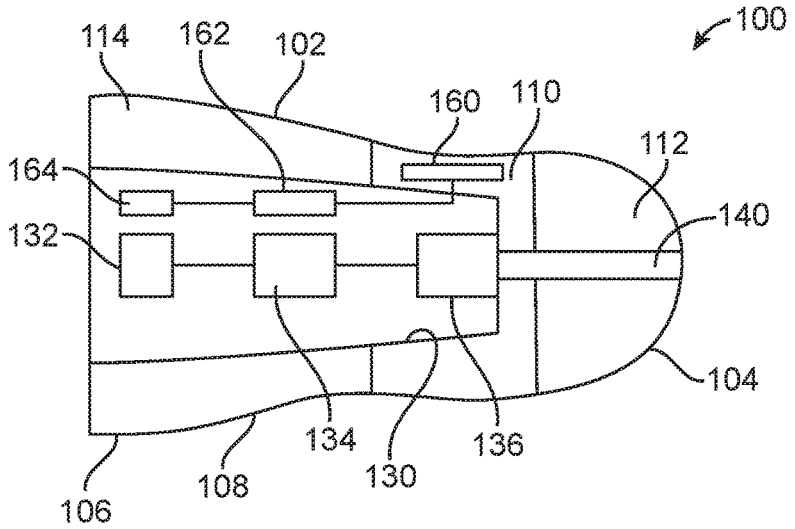
FIG. 4 illustrates a hearing device.

In any of the embodiments described herein, the earpiece 102 may also include a component, or may be coupled to a component, wherein the component is configured to provide stimulus for causing the first portion 110 to exhibit the first property in a the first state in response to the stimulus. FIG. 4 illustrates a hearing device 100 having an earpiece 102. The earpiece 102 may be the same as that described with reference to any of the embodiments of FIGS. 2-3. As shown in FIG. 4, the earpiece 102 also includes an effector 160 coupled to the first portion 110, a component 162 configured to provide a stimulus via the effector 160, and a signal receiver 164 coupled to the component 162. In the illustrated embodiments, the signal receiver 164 is configured to receive an input provided to the earpiece 102. The input may be provided to the earpiece 102 by an external device (such as a fitting device, a cell phone, a remote control, a cloud server, or a computing device) which transmits the input for reception by the signal receiver 164 of the earpiece 102. In response to the input received by the signal receiver 164, the component 162 then generates a signal to cause the first portion 110 of the earpiece 102 to change state via the effector 160. In some cases, the cloud server and/or the fitting device may provide control signals to adjust the earpiece 102 configuration as a first-step fitting, and then the user can use the cell phone and/or the remote control to provide control signals to further adjust the earpiece 102 configuration for fine-tuning.

In some embodiments, the effector 160 is configured to emit heat, and the first portion 110 is made from a material that is configured to change property in response to the heat or lack of the heat. In such cases, the heat emitted by the effector 160 is configured to interact with the material of the first portion 110 to thereby cause the first portion 110 to exhibit the first property in the first state. Alternatively, the effector 160 may include an actuator that is responsive to heat. In such cases, the actuator may be configured to bend the first portion 110 in response to the heat provides by the effector 160.

In other embodiments, the effector 160 is configured to emit light in a certain frequency, and the first portion 110 is made from a material that is configured to change property in response to the light or lack of the light. The effector 160 may be implemented using one or more light emitting diodes. In such cases, the light emitted by the effector 160 is configured to interact with the material of the first portion 110 to thereby cause the first portion 110 to exhibit the first property in the first state. Alternatively, the effector 160 may include an actuator that is responsive to light. In such cases, the actuator may be configured to bend the first portion 110 in response to the light provided by the effector 160.

In other embodiments, the effector 160 is configured to provide a current (or electrical signal), and the first portion 110 is made from a material that is configured to change property in response to the current or lack of the current. The effector 160 may be implemented using one or more electrodes. In such cases, the current provided by the effector 160 is configured to interact with the material of the first portion 110 to thereby cause the first portion 110 to exhibit the first property in the first state. Alternatively, the effector 160 may include an actuator that is responsive to current. In such cases, the actuator may be configured to bend the first portion 110 in response to the current provided by the effector 160.

In other embodiments, the effector 160 is configured to provide moisture, and the first portion 110 is made from a material that is configured to change property in response to the moisture or lack of the moisture. The effector 160 may be implemented using a material (e.g., a hydrogel) that reacts in response to moisture. In such cases, the moisture provided by the effector 160 is configured to interact with the material of the first portion 110 to thereby cause the first portion 110 to exhibit the first property in the first state. Alternatively, the effector 160 may include an actuator that is responsive to moisture. In such cases, the actuator may be configured to bend the first portion 110 in response to the moisture provided by the effector 160.

In further embodiments, the effector 160 may be a mechanical structure configured to apply pressure or force to bend the first portion 110. By means of non-limiting examples, the mechanical structure may be an arm, a rod, a plate, etc., that is configured to bend in response to signal received from the component 162.

In any of the embodiments described herein the effector 160 may be considered to be a part of the component 162.

Figure 5:
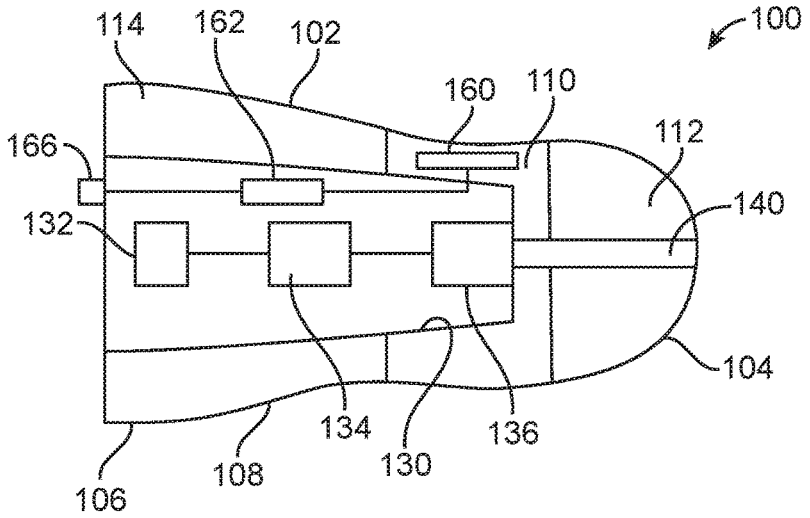
FIG. 5 illustrates a hearing device.

In the above embodiments, the earpiece 102 includes the signal receiver 164 for receiving an input provided to the earpiece 102 provided by an external device. In other embodiments, instead of having the signal receiver 164, the earpiece 102 may include a user control 166 for operating the component 162 (FIG. 5). The user control 166 may be implemented as a button, a knob, etc. During use, if the user of the earpiece 102 experiences discomfort when using the earpiece 102, the user may operate the user control to cause the component 162 and the effector 160 to change the state of the first portion 110 of the earpiece 102. For example, based on the input provided via the user control 166, the first portion 110 may change shape and/or may become more flexible. This may allow the first portion 110 to change configuration (e.g., shape, flexibility, elasticity, etc.) to better conform to a shape of the ear canal. When the stimulus provided via the effector 160 is removed, the first portion 110 may become less flexible to thereby allow the shape of the first portion 110 (which has now changed) to retain.

Figure 6:
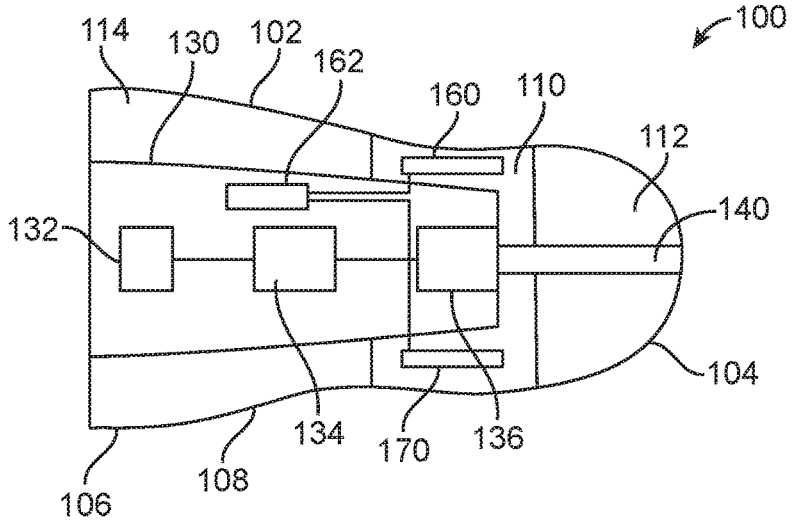
FIG. 6 illustrates a hearing device.

In other embodiments, instead of, or in addition to, having the signal receiver 164 and/or the user control 166, the earpiece 102 may include a sensor 170 coupled to the first portion 110 for sensing a condition (e.g., characteristic) of the first portion 110 (FIG. 6). In response to the sensed condition, the component 162 then generates a signal to operate the effector 160 to thereby cause the first portion 110 to change state. By means of non-limiting examples, the sensor 170 may be a force sensor, a pressure sensor, a strain gauge, etc. During use, the sensor 170 may sense an increase in pressure, force, or strain experienced by the first portion 110 due to movement of the ear canal of the user. In response to such sensed condition, the component 162 then operates the effector 160 to cause the first portion 110 to change state. For example, the component 162 may operate the effector 160 to provide stimulus in response to the sensed condition. The stimulus may be heat, light, current, force, pressure, etc. The first portion 110 may change shape and/or may become more flexible based on the stimulus. This may allow the first portion 110 to change configuration (e.g., shape, flexibility, elasticity, etc.) to better conform to a changing shape of the ear canal.

Figure 7:
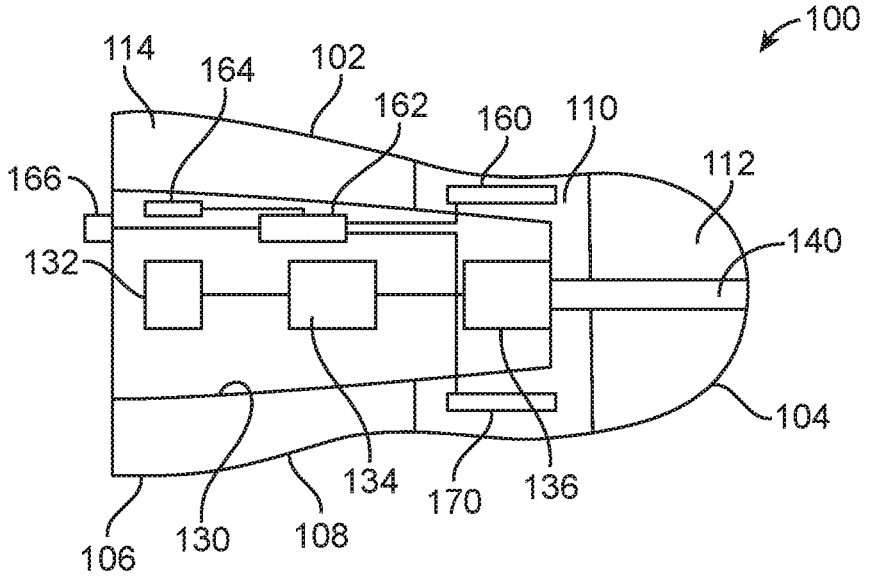
FIG. 7 illustrates a hearing device.

In other embodiments, any of the features described herein may be combined. For example, as shown in FIG. 7, in other embodiments, the earpiece 102 may include the signal receiver 164 of FIG. 4, the user control 166 of FIG. 5, and the sensor 170 of FIG. 6. During use, the signal receiver 164 and the user control 166 provides two different ways for receiving input from the user. The component 162 then operates the effector 160 in response to the input to thereby cause the first portion 110 of the earpiece 102 to change property. The sensor 170 allows the first portion 110 to change property automatically in response to certain detected condition to obviate the need for the user to provide input.

Figure 8:
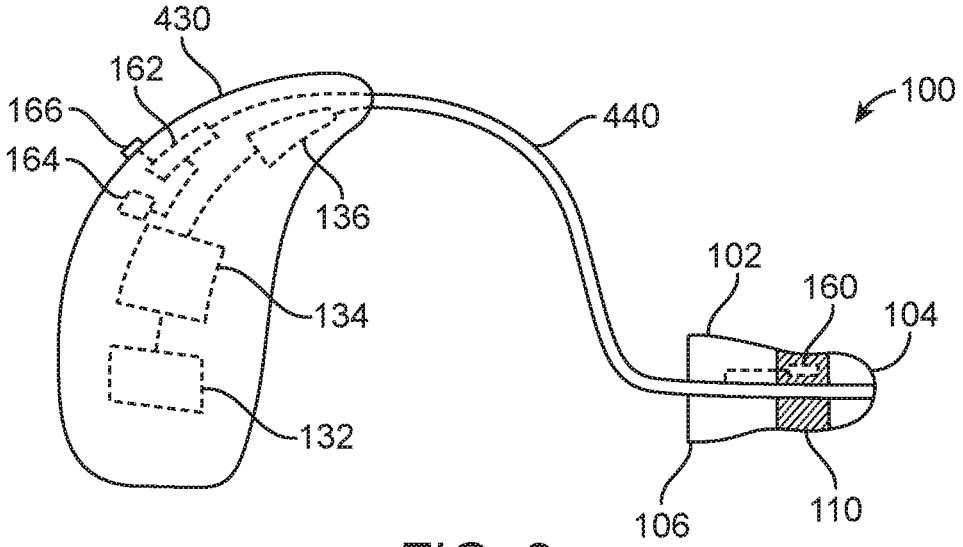
FIG. 8 illustrates a hearing device.

In the above embodiments, the hearing device 100 has been described as an earpiece, which may be a stand-alone device, such as a hearing aid. In other embodiments, the earpiece 102 may be a part of a hearing device 100 that further includes a behind-the-ear (BTE) component 430 and an elongated member 440 that is connected between the BTE component 430 and the earpiece 102 (FIG. 8). The BTE component 430 includes a microphone 132, a processing unit 134, and a receiver (speaker 136). During use, the BTE component 430 is worn behind an ear of the user. The microphone 132 picks up sound from the environment and converts the sound to audio signal. The processing unit 134 is configured to process the audio signal in accordance with a hearing loss compensation algorithm to compensate for hearing loss of the user of the earpiece 102. The processing unit 134 may be implemented using hardware, software, or a combination of both. The processing unit 134 outputs a processed audio signal compensating for the hearing loss of the user, and the receiver 136 converts the processed audio signal into output sound. The output sound is transmitted via the elongated member 440, which is a sound tube in the illustrated embodiments, and exits from the earpiece 102 for reception by an eardrum of the user.

The BTE component 430 also includes the component 162, the signal receiver 164, and the user control 166 as similarly discussed. As shown in the figure, the earpiece 102 includes the first portion 110, which is configured to exhibit property change in response to a stimulus. The earpiece 102 also includes the effector 160 coupled to the first portion 110. The component 162 at the BTE component 430 is communicatively coupled to the effector 160 at the earpiece 102 via one or more electrical wires that are accommodated in the elongated member 440. During use, the user may operate the user control 166. In response to input received via the user control 166, the component 162 then operates the effector 160 to cause the first portion 110 of the earpiece 102 to change property. For examples, the effector 160 may provide heat, light, current, etc. as stimulus to interact with the material of the first portion 110. As other examples, the effector 160 may be a mechanical structure that provides force or pressure as stimulus to mechanically bend the first portion 110. Alternatively, an input may be provided by an external device (e.g., a fitting device, a cell phone, a remote control, a cloud server, or a computing device) for reception by the signal receiver 164. In some cases, the cloud server and/or the fitting device may provide control signals to adjust the earpiece 102 configuration as a first-step fitting, and then the user can use the cell phone, the remote control, and/or the user control 166 to provide control signals to further adjust the earpiece 102 configuration for fine-tuning. In response to the input received via the signal receiver 164, the component 162 then operates the effector 160 to cause the first portion 110 of the earpiece 102 to change property. In some embodiments, the hearing device 100 may optionally further include the sensor 170 coupled to the first portion 110 as similarly discussed. The sensor 170 may be coupled to the component 162 via one or more electrical wires accommodated in the elongated member 440. During use, the sensor 170 senses a condition, and the component 162 then operates the effector 160 to cause the first portion 110 to change property in response to the sensed condition.

In other embodiments, the hearing device 100 of FIG. 8 may not include the user control 166 and/or the signal receiver 164. Also, in other embodiments, the hearing device 100 of FIG. 8 may not include the component 162 and the effector 160.

Figure 9:
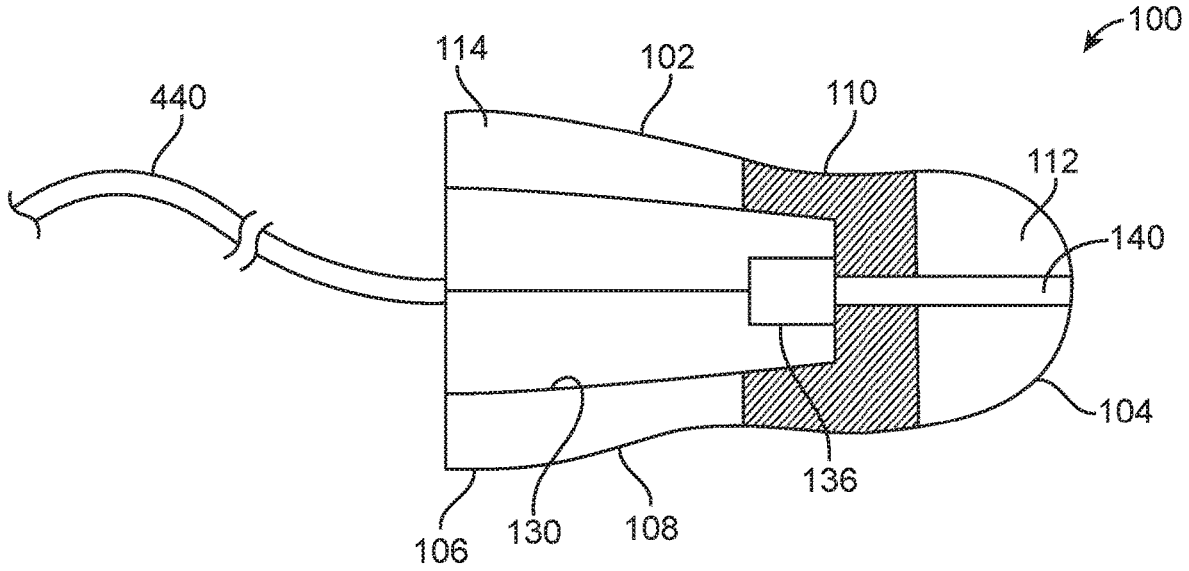
FIG. 9 illustrates a hearing device.
Figure 10:
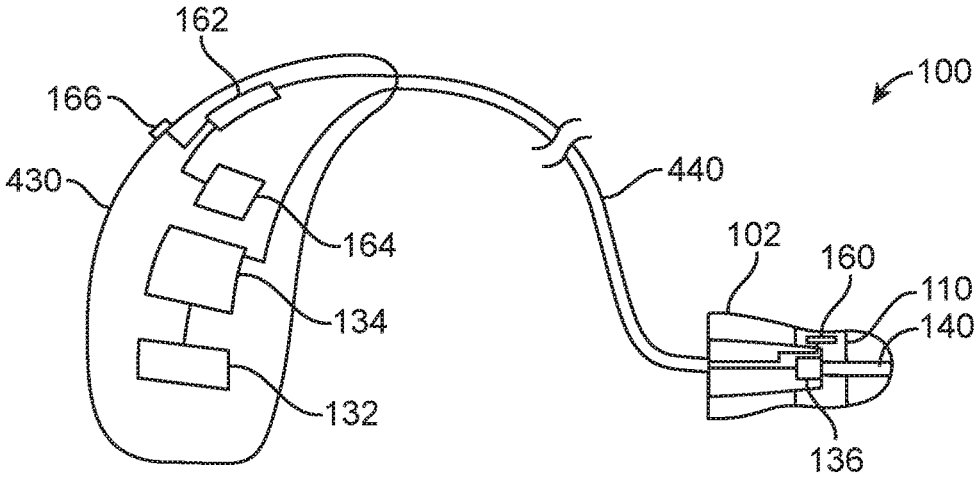
FIG. 10 illustrates a hearing device.

In other embodiments, instead of having the receiver 136 accommodated in the BTE component 430, the receiver 136 may be implemented at the earpiece 102 (FIG. 9-10). The hearing device 100 of FIG. 10 is the same as that described in FIG. 8, except that the receiver 136 is located in the earpiece 102, and that the elongated member 440 is a cable (instead of a sound tube) with electrical wires. During use, the BTE component 430 is worn behind an ear of the user. The microphone 132 picks up sound from the environment and converts the sound to audio signal. The processing unit 134 is configured to process the audio signal in accordance with a hearing loss compensation algorithm to compensate for hearing loss of the user of the earpiece 102. The processing unit 134 may be implemented using hardware, software, or a combination of both. The processing unit 134 outputs a processed audio signal compensating for the hearing loss of the user. The processed audio signal is transmitted via the wire(s) in the elongated member 440 to the receiver 136 at the earpiece 102. The receiver 136 converts the processed audio signal into output sound. The output sound is transmitted via the passage 140 at the earpiece 102, and exits from the earpiece 102 for reception by an eardrum of the user.

In some embodiments, the elongated member 440 may have a length that is customized for specific user. In some embodiments, the customization of the elongated member 440 may be performed based on ear mold impression, scanned data, images of user's ear, three-dimensional modelling of the user's ear, or any combination of the foregoing. Customizing the length of the elongated member 440 may be advantageous. If the length of the elongated member 440 is too short then the earpiece 102 will not fit properly in the ear canal, and the longitudinal axis of the earpiece 102 will not be parallel to the central axis of the ear canal and may cause a reduced comfort for the user. If the length of the elongated member 440 is too long, the elongated member 440 may stick out from the side of the ear and become visually displeasing for the user. Furthermore, if the elongated member 440 is too long, the BTE component may be improperly secured to the ear of the user, which may lead to that the BTE component may easily fall of the ear and be lost. Thus, it may be desirable for the personalisation to get a proper and fitting length for the elongated member 440 for the specific user.

In some embodiments, the first portion 110 of the earpiece 102 may be fabricated using 3D or 4D printing technology. In such cases, the first portion 110 may comprise one or more printing materials. In some embodiments, the entire body 108 of the earpiece 102 may be made from a single printing material. In other embodiments, different portions of the earpiece 102 may be made from different printing materials with different properties. For example, a circumferential part of the first portion 110 may be made from a first material while an inner part of the first portion 110 may be made from a second material that is different from (e.g., stiffer or softer than) the first material.

Figure 11:
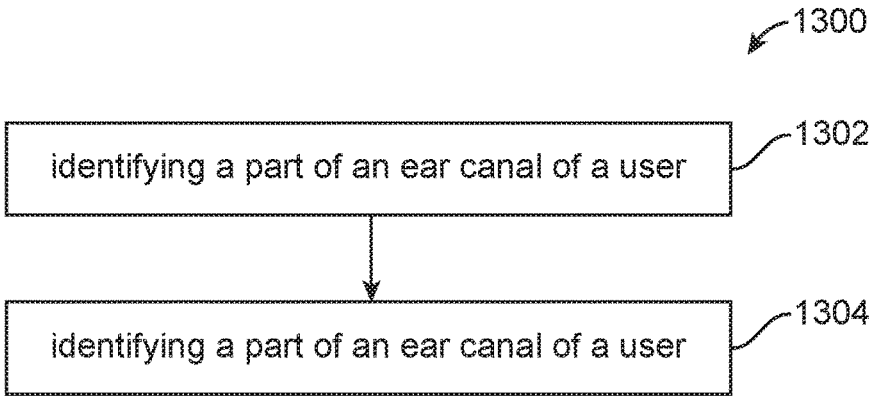
FIG. 11 illustrates a method of making a hearing device.

FIG. 11 illustrates a method 800 of making a hearing device. The method 1300 includes: identifying a part of an ear canal of a user (item 1302); and making a first portion of the earpiece 102 based at least on the identified part of the ear canal (item 1304). The identified part of the ear canal may be one that changes shape due to a physiological movement of the user. By means of non-limiting examples, the physiological movement may be jaw movement, head turn, etc.

In some embodiments, the part of the ear canal may be identified based on scanned data or ear mold impression.

In some embodiments, a scanning may be performed to obtain scanned data of the ear canal, and the part of the ear canal may be identified based on the scanned data. The scanning may be performed using a handheld scanning device with a probe that is configured to be inserted into the ear canal for scanning purpose. The handheld scanning device may emit light, ultrasound, or other forms of energy for scanning the ear canal. In one implementation, the handheld device may perform optical coherence tomography (OCT) to scan the ear canal. In some cases, OCT may provide high resolution images (1-10 μm) for skin with penetration depth of 1 mm. In other embodiments, an ear mold impression of the ear canal may be made, and the part of the ear canal may be identified based on the ear mold impression.

Also, in some embodiments, scanning or monitoring may be performed to determine the part of the ear canal that exhibits changes due to physiological movements. In one implementation, a first scanning may be performed while the user has his/her jaw closed to obtain a first scan of the ear canal. Then a second scanning may be performed while the user has his/her jaw opened to obtain a second scan of the ear canal. The first scan and the second scan may then be compared to identify a change in a shape of the ear canal, and the location where the change in shape occurs due to jaw movement. Similar technique may be performed to determine a change in shape of an ear canal due to head turn. For example, a first scanning may be performed while the user's head is at a first orientation to obtain a first scan of the ear canal. Then a second scanning may be performed while the user's head is at a second orientation to obtain a second scan of the ear canal. The first scan and the second scan may then be compared to identify a change in a shape of the ear canal, and the location where the change in shape occurs due to head turn.

In other embodiments, a first ear impression may be made while the user has his/her jaw closed to obtain a first impression of the ear canal. A second ear impression may be made while the user has his/her jaw opened to obtain a second impression of the ear canal. The first impression and the second impression may then be compared to identify a change in a shape of the ear canal, and the location where the change in shape occurs due to jaw movement. For example, the first impression may be scanned to create a first computer model, and the second impression may be scanned to create a second computer model. The first computer model and the second computer model may then be compared with each other. Similar technique may be performed to determine a change in shape of an ear canal due to head turn.

Figure 12:
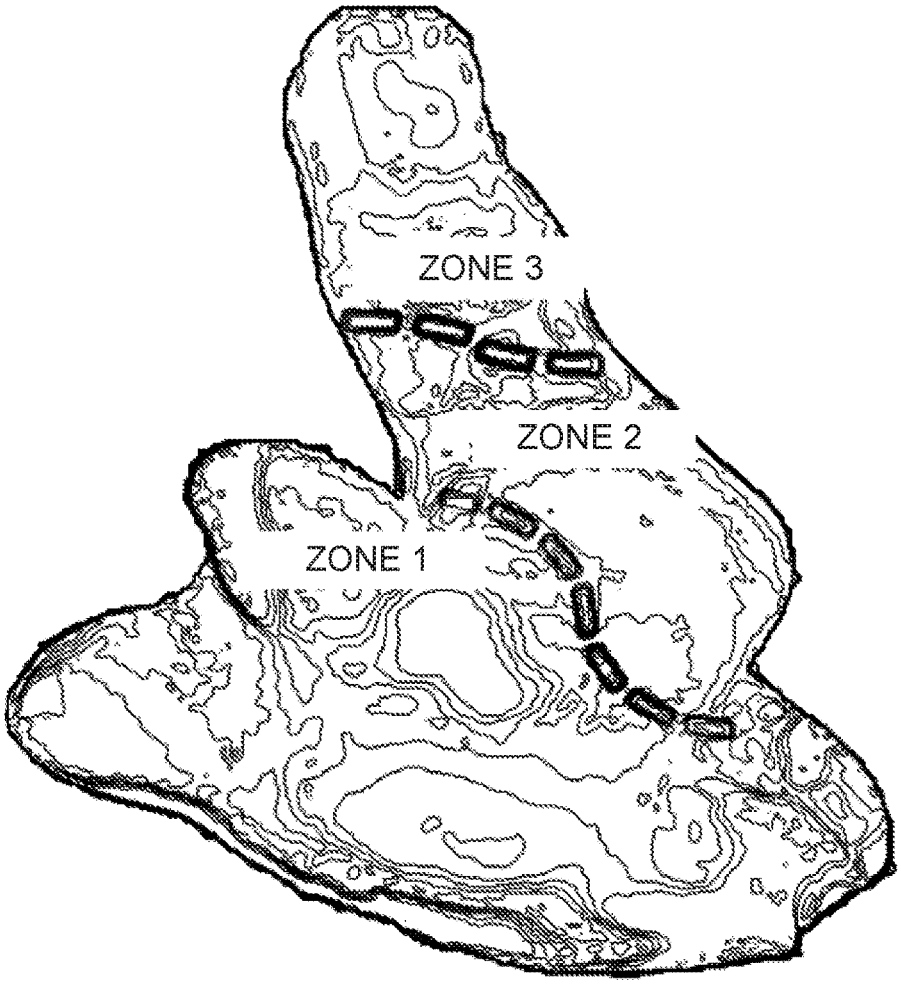
FIG. 12 illustrates different zones of a hearing device to be made.

In some embodiments, the scanning and/or ear impressions may be performed to create a three-dimensional diagram like that shown in FIG. 12. As shown in the figure, differences in geometrical shape between open and closed jaw may be identified in the impression and/or scan data. Changes in ear shape, (such as the shape of the outer ear, the shape of the ear canal, etc.) are specific to different regions of the ear, and differential expansion and contraction may occur within the same ear of the user. In some embodiments, these different regions may be identified, and an earpiece may be created based on these identified regions. In one implementation, three zones may be identified—i.e., zone 1 being the region from cavum concha to first bend of ear canal, zone 2 being the region between the first ear canal bend and the second ear canal bend, and zone 3 being the region beyond the second bend. Also, in some embodiments, different materials or different combination of materials may be used to make different portions of an ear piece corresponding to the different identified regions or zones. In some embodiments, a more flexible material, and/or a material that has shape memory characteristic may be employed to construct a hinge (e.g., with a bending plane along which deformation occurs) or demarcate zone for portion of the earpiece, such that the portion of the earpiece may expand or contract in a controllable fashion. Optionally, one or more effectors (e.g., effector 160) and one or more sensors (e.g., sensor 170) may be placed at susceptible areas within each zone to measure changes in pressure, temperature, movement, etc.

In some embodiments, one or more characteristics of the first portion 110 may be customized to specific user. For example, in some embodiments, the first portion 110 may have a length (e.g., a longitudinal length along a direction of the ear canal) that is customized. As another example, the first portion 110 may have a shape, dimension, and/or curvature that is customized to correspond with a shape of the anatomy of a specific user.

Customization of the shape, dimension, and/or curvature of the first portion 110 is advantageous because it provides a more secure fit for the user. In some embodiments, the position and orientation of the passage 140 may also be customizable, which allows a sound emitting position and direction to be adjusted. Also, in some embodiments, the position of the speaker 136 relative to the body 108 of the earpiece 102 may also be customizable. This allows the speaker 136 to be centered in the ear canal opening.

In some embodiments, in the method 1300, the act of making the first portion comprises performing 3D or 4D printing. The printing material for the flexible member may be a biocompatible material. Also, in some cases, multiple printing materials may be used. For example, the printing may utilize a first printing material with a first stiffness, and a second printing material with a second stiffness that is less than the first stiffness. Thus, the second printing material may be more flexible than the first printing material. In some embodiments, the second printing material may be used to make the first portion. Also, in some embodiments, the second printing material may be used to make a proximal part (the part closer to an eardrum) of the earpiece, and the first printing material may be used to make a distal part of the earpiece.

In some embodiments, the method 1300 may further comprise making a second portion of the earpiece. The second portion may be stiffer compared to the first portion. The joint between first portion and the second portion of the earpiece may be an adhesive or a flexible material. For example, the first and second portions may be secured to each other via an adhesive or a flexible material after they are formed. Alternatively, the first portion and the second portion may be formed together so that they have an unity configuration. Also, in some embodiments, the first portion may be made from a first material, and the second portion may be made from a second material that is stiffer than the first material.

In further embodiments, the method 1300 may further comprise making a third portion of the earpiece. The third portion may be stiffer compared to the first portion. The joint between the first, second, and third portions of the earpiece may be an adhesive or a flexible material. For example, the first portion, the second portion, and the third portion of the earpiece may be secured to each other via an adhesive or a flexible material, after they are formed. Alternatively, the first portion, the second portion, and the third portion may be formed together so that they have an unity configuration. Also, in some embodiments, the first portion may be made from a first material, and the third portion may be made from a second material that is stiffer than the first material.

In some embodiments, the method 1300 may further include securing the first portion 110 relative to a housing. For example, the first portion 110 may be secured to the housing via an adhesive and/or friction. In one implementation, the first portion 110 may be coupled to, or may form at least a part of, a sleeve. In such cases, the sleeve may accommodate the housing of the earpiece.

In some embodiments, the method 1300 is for making an earpiece that is a stand-alone device. In such cases, the method 1300 may further include providing a battery compartment in the earpiece, and a battery door for the earpiece.

In other embodiments, the method 1300 is for making a hearing device that includes an external component (e.g., a BTE) for providing a signal to the earpiece. In such cases, the method 1300 may further include making an elongated member for coupling with the earpiece. The elongated member may have a customized length or a standard length. In some embodiments, an elongated member length between the earpiece and the BTE may be determined based on ear mold impression, images of a user's ear, or a computerized model.

Figure 13:
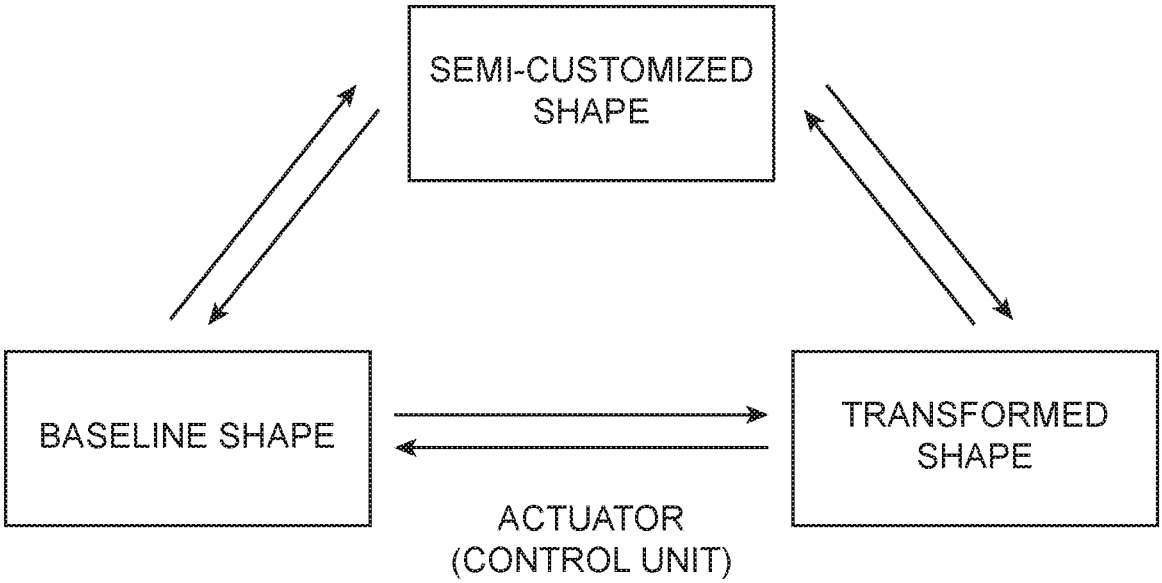
FIG. 13 illustrates different states of a hearing device.

FIG. 13 illustrates different states of a hearing device. First, a baseline shape of a hearing device is provided. The baseline shape may be an average shape obtained from a database of ear geometries. Thus, the baseline shape may represent an average shape of a population of individuals. Alternatively, the baseline shape may be input from a 3D scanning of a user's ear using a hand-held scanner or a mobile phone. Alternatively or additionally, the user may enter biometric information (e.g., age, gender, ethnicity, etc.) into an application, which informs a control unit to transform the baseline shape into a semi-customized shape that is more specific to the user. Also, information regarding deformation in the ear canal (e.g., due to jaw movement, head turn, etc.) may be obtained, and the shape of the earpiece may be adjusted based on such information to achieve a transformed shape. In some embodiments, the information regarding deformation in the ear canal may be obtained before the earpiece is made. In such cases, the earpiece may be constructed based on such information, so that the earpiece will have a transformed shape. For example, based on such information, a certain portion of the earpiece at a certain location may be made using a more flexible and/or shape-memory material, and/or made with a different shape. Alternatively or additionally, the information regarding deformation of the ear canal may be obtained in real-time during use of the earpiece. For example, deformation of the ear canal may be monitored in real time using sensor(s) as similarly discussed. The sensor(s) detects changes specific to zones, which detected changes are transmitted to the component 162. The component 162 operates as a controller that regulates the material property of the portion 110 of the earpiece, so that the earpiece achieves a more appropriate shape (determined from a database) or a user-configured shape to achieve the transformed shape. In some cases, the states regarding the portion 110 of the earpiece may be stored in a memory in the hearing device 102. In such cases, transition between these states may be triggered by a sensor measurement that indicates active ear dynamics or lack thereof. In some embodiments, an earpiece may be constructed based on the baseline shape. In other embodiments, an earpiece may be constructed based on the semi-customized shape. In further embodiments, the earpiece may be constructed based on the transformed shape.

Embodiments of the hearing device 100 described herein are advantageous. This is because the customized portion 110 of the earpiece 102 allows a user to have ultimate personalization in terms of the fit of the hearing device in the ear. Also, in the embodiments in which the portion 110 is user configurable, such feature allows the user to adjust the earpiece 102 whenever needed without requiring a fitter. By using material(s) that changes shape within the ear, the earpiece provides flexibility during initial fit and also flexibility to accommodate dynamic ear canal changes. Thus, the earpiece provides an improvement in comfort relative to the hard acrylic materials currently used. A well-fitted custom hearing device reduces likelihood of acoustic leakage and resultant feedback, and also increases the likelihood of providing sufficient gain. It also provides good passive noise attenuation.

Embodiments described herein will also be of high value to the Over-The-Counter (OTC) market since it would allow the fitting to be performed with no dispenser or audiologist being present.

Also, embodiments of the hearing device 100 described herein are advantageous because they may allow a deeper placement (due to the hearing device 100 having more flexible zone(s) for accommodating ear canal movements) into the ear canal while providing comfort to the user. The deeper placement of the hearing device 100 reduces the space between the hearing device 100 and the eardrum, which leads to reduced occlusion effect, reduced feedback, improved modulation of user's own voice, and improved communication.

The use of the terms "first", "second", etc. does not imply any particular order, but are included to identify individual elements. Moreover, the use of the terms "first", "second", etc. does not denote any order or importance, but rather the terms "first", "second", etc. are used to distinguish one element from another. Note that the words "first", "second", etc. are used here and elsewhere for labelling purposes only and are not intended to denote any specific spatial or temporal ordering.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

The invention claimed is:

1. An earpiece comprising:

a first portion configured for placement in an ear canal, the first portion having an asymmetrical configuration;

wherein the first portion is configured to exhibit a first property in a first state in response to a stimulus, and to exhibit a second property in a second state in an absence of the stimulus, and wherein the first portion is asymmetrical when the first portion is in the first state and in the second state;

wherein the first portion is elastically compressible when the first portion is in the first state and the second state; and wherein at least a part of the first portion is configured to contact a surface of the ear canal or to exert a force towards the surface of the ear canal, when the first portion exhibits the first property in the first state, and when the first portion exhibits the second property in the second state.

2. The earpiece of claim 1, wherein the first portion can reversibly achieve the first state and the second state.

3. The earpiece of claim 1, wherein the first portion is customized, or a location of the first portion with respect to a remaining part of the earpiece is customized.

4. The earpiece of claim 1, wherein the first property comprises a first stiffness, and the second property comprises a second stiffness that is higher than the first stiffness.

5. The earpiece of claim 1, wherein the first property comprises a first shape, and the second property comprises a second shape that is different from the first shape.

6. The earpiece of claim 1, wherein the earpiece comprises a component, or is coupled to a component, the component configured to provide the stimulus.

7. The earpiece of claim 6, wherein the stimulus is for interacting with material of the first portion.

8. The earpiece of claim 6, wherein the earpiece is a part of a hearing device, and wherein the component is configured to provide the stimulus in response to an input received by the hearing device.

9. The earpiece of claim 8, wherein the stimulus comprises heat, light, pressure, force, or an electrical signal.

10. The earpiece of claim 6, further comprising a user control configured to receive a user input, wherein the stimulus by the component is based on the user input.

11. The earpiece of claim 6, further comprising a wireless receiver configured to receive a signal from a device, wherein the stimulus by the component is based on the signal.

12. The earpiece of claim 11, wherein the device comprises a fitting device, a cell phone, a remote control, a cloud server, or a computing device.

13. The earpiece of claim 6, further comprising a sensor configured to sense a characteristic, wherein the component is configured to provide the stimulus in response to the sensed characteristic.

14. The earpiece of claim 1, wherein the first portion is made from a material having a shape memory characteristic.

15. The earpiece of claim 14, wherein the material comprises a printed material.

16. The earpiece of claim 1, wherein the first portion is configured for placement at a location along an ear canal that changes shape in response to jaw movement of a user of the earpiece.

17. The earpiece of claim 1, further comprising a second portion and a third portion, wherein the first portion is a hinge zone connecting the second portion and the third portion.

18. The earpiece of claim 1, wherein the first portion is at least a part of a shell.

19. The earpiece of claim 1, wherein the first portion is asymmetrical with respect to a longitudinal axis of the earpiece when the first portion is in the first state and when the first portion is in the second state.

20. A hearing aid having the earpiece of claim 1, wherein the hearing aid comprises a processor configured to perform hearing loss compensation.

21. A hearing device comprising:

a component configured to generate an output; and an earpiece having a first portion configured to change shape or a material property in response to the output generated by the component;

wherein the first portion that is configured to change shape or the material property is configured for placement in an ear canal, wherein a first part of the first portion has a first cross-sectional dimension, wherein a second part of the first portion has a second cross-sectional dimension that is less than the first cross-sectional dimension, and wherein the second part is configured for insertion into the ear canal before the first part; and wherein at least a part of the first portion is configured to contact a surface of the ear canal or to exert a force towards the surface of the ear canal, before and after the first portion changes shape or the material property.

22. The hearing device of claim 21, wherein the output comprises a stimulus for interacting with material of the first portion.

23. The hearing device of claim 21, wherein the component is configured to generate the output in response to an input received by the hearing device.

24. The hearing device of claim 21, wherein the output comprises heat, light, pressure, force, or an electrical signal.

25. The hearing device of claim 21, further comprising a user control configured to receive a user input, wherein the output generated by the component is based on the user input.

26. The hearing device of claim 21, further comprising a wireless receiver configured to receive a signal from a device, wherein the output generated by the component is based on the signal.

27. The hearing device of claim 26, wherein the device comprises a fitting device of a cell phone.

28. The hearing device of claim 21, wherein the first part and the second part of the first portion that is configured to change shape or the material property extend from each other and together form an unity structure.

29. The hearing device of claim 21, wherein the component comprises an actuator configured to bend the first portion of the earpiece to cause the first portion to change shape.

30. The hearing device of claim 21, further comprising a sensor configured to sense a characteristic, wherein the component is configured to generate the output in response to the sensed characteristic.

31. The hearing device of claim 30, wherein the sensor comprises a temperature sensor, a pressure sensor, a force sensor, a strain gauge, a light sensor, or an electric signal sensor.

32. The hearing device of claim 21, wherein the first portion is made from a material having a shape memory characteristic.

33. The hearing device of claim 32, wherein the material comprises a printed material.

34. The hearing device of claim 21, wherein the first portion is configured for placement at a location along the ear canal that changes shape in response to jaw movement of a user of the hearing device.

35. The hearing device of claim 21, wherein the first portion is configured for placement at a first bend of the ear canal, the ear canal having a second bend located between the first bend and an eardrum.

36. The hearing device of claim 35, further comprising a second portion configured for placement at the second bend of the ear canal.

37. The hearing device of claim 21, further comprising a second portion and a third portion, wherein the first portion is a hinge zone connecting the second portion and the third portion.

38. The hearing device of claim 37, wherein the first portion, the second portion, and the third portion are integrally formed together.

39. The hearing device of claim 21, wherein the component is in the earpiece.

40. The hearing device of claim 21, wherein the first portion is at least a part of a shell.

41. The hearing device of claim 40, further comprising a speaker accommodated in the shell.

42. The hearing device of claim 21, wherein the first portion has a geometry that is customized.

43. The hearing device of claim 21, wherein the hearing device comprises a hearing aid with a processor configured to perform hearing loss compensation.

44. The hearing device of claim 21, wherein the first portion has an asymmetrical configuration;

wherein the first portion is configured to exhibit a first property in a first state in response to a stimulus, and to exhibit a second property in a second state in an absence of the stimulus; and wherein the first portion is elastically compressible when the first portion is in the first state and the second state.

45. The hearing device of claim 21, wherein the ear canal has a first bend and a second bend located between the first bend and an eardrum, and wherein the first portion is configured for placement at the second bend of the ear canal.

46. The hearing device of claim 21, wherein the component is in a behind-the-ear (BTE unit) of the hearing device.

* * * * *